US005120352A

United States Patent [19]

Jackson et al.

[11] Patent Number: 5,120,352

[45] Date of Patent: Jun. 9, 1992

[54] METHOD AND APPARATUS FOR MAKING ALLOY POWDER

[75] Inventors: Joseph J. Jackson, Topsfield, Mass.; Richard G. Menzies, Cincinnati; Joseph Hopkins, Maineville, both of Ohio

[73] Assignee: General Electric Company, Cincinnati, Ohio

[21] Appl. No.: 779,827

[22] Filed: May 2, 1992

Related U.S. Application Data

[63] Continuation of Ser. No. 549,669, Jul. 6, 1990, abandoned, which is a continuation of Ser. No. 420,706, Oct. 11, 1989, abandoned, which is a continuation of Ser. No. 287,673, Dec 10, 1988, abandoned, which is a continuation of Ser. No. 150,477, Jan. 28, 1988, abandoned, which is a continuation of Ser. No. 738,499, May 28, 1985, abandoned, which is a continuation of Ser. No. 507,255, Jun. 23, 1983, abandoned.

[51] Int. Cl.[5] ..... C22B 1/00

[52] U.S. Cl. ..... 75/346; 75/352; 425/7

[58] Field of Search ..... 425/6, 7, 8; 75/331, 75/338, 339, 10.65, 346, 352; 264/5, 12, 13, 14

[56] References Cited

U.S. PATENT DOCUMENTS

| | | | |
|---|---|---|---|
| 2,618,013 | 11/1952 | Weigand et al. | 425/7 |
| 2,790,019 | 4/1957 | Stalego | 425/6 |
| 2,873,102 | 2/1959 | Tripmacher et al. . | |
| 3,099,041 | 7/1963 | Kaufmann | 264/88 |
| 3,342,250 | 9/1967 | Treppschuh et al. | 164/469 |
| 3,447,920 | 6/1969 | Bartu . | |
| 3,744,943 | 7/1973 | Bomberger, Jr. et al. | 425/6 |
| 3,826,598 | 7/1974 | Kaufmann | 425/7 |
| 4,067,674 | 1/1978 | Devillard | 425/8 |
| 4,218,410 | 8/1980 | Stephan et al. | 264/8 |
| 4,295,808 | 10/1981 | Stephan et al. | 425/8 |
| 4,468,183 | 8/1984 | Ramser et al. | 425/7 |
| 4,544,404 | 10/1985 | Yolton et al. | 264/12 |

FOREIGN PATENT DOCUMENTS

| | | | |
|---|---|---|---|
| 38-9401 | 7/1963 | Japan . | |
| 54-442 | 1/1979 | Japan . | |
| 57-75128 | 5/1982 | Japan | 425/7 |
| 79-00132 | 3/1979 | PCT Int'l Appl. | 425/7 |
| 1296288 | 11/1972 | United Kingdom . | |
| 1514379 | 6/1978 | United Kingdom . | |
| 1529858 | 10/1978 | United Kingdom . | |
| 2117417 | 10/1983 | United Kingdom . | |

*Primary Examiner*—Jill L. Heitbrink

*Attorney, Agent, or Firm*—Jerome C. Squillaro; Carmen Santa Maria

[57] ABSTRACT

An improved method for making a metal powder employs improved apparatus comprising, in combination, a fluid-cooled hearth for receiving metallic material which defines an alloy and which is to be melted, a plasma heat source adapted to melt the metallic material, a powder metal producer, and means to introduce the molten metallic material from the hearth into the powder metal producer. The fluid-cooled walls of the hearth resolidify a portion of the molten metallic material to form a skull as a barrier between the hearth and additional molten alloy produced within the hearth. This method and apparatus restricts introduction of impurities into the molten alloy which is later introduced into the powder metal producer. In one form, a fluid-cooled pouring trough, as a stream control device, can be disposed between the hearth and the powder producer to receive molten metal from the hearth and to introduce it into the powder metal producer.

20 Claims, 1 Drawing Sheet

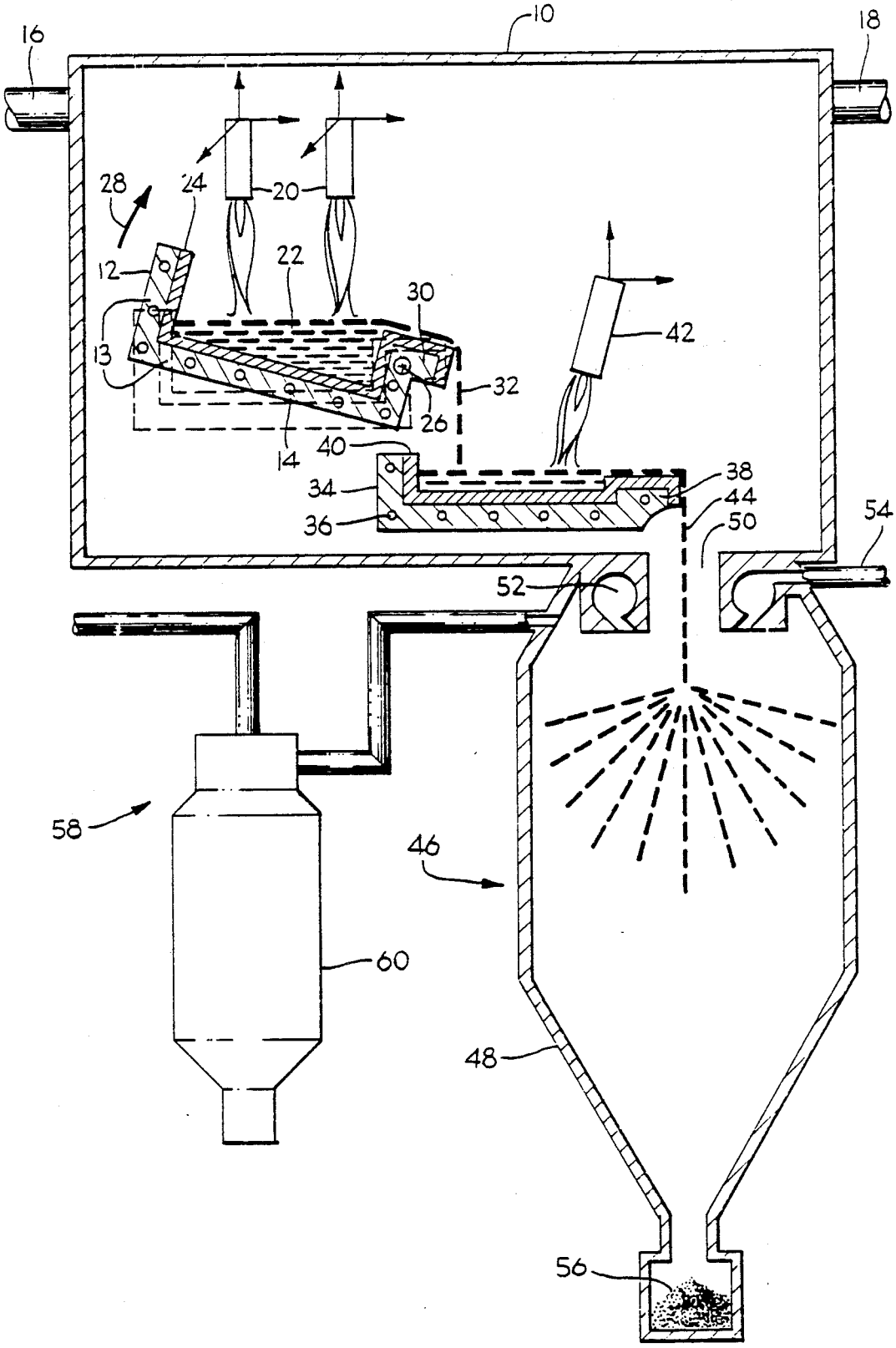
10
16
18
28
24
20
12
22
30
42
13
32
26
14
40
34
38
44
36
50
54
52
58
46
60
48
56

METHOD AND APPARATUS FOR MAKING ALLOY POWDER

BACKGROUND OF THE INVENTION

This application is a continuation of application Ser. No. 07/549,669 filed Jul. 6, 1990, now abandoned, which is a continuation of application Ser. No. 07/420,706 filed Oct. 11, 1989, now abandoned, which is a continuation of application Ser. No. 07/287,673 filed Dec. 20, 1988, now abandoned, which is a continuation of application Ser. No. 07/150,477 filed Jan. 28, 1988, now abandoned, which is a continuation of application Ser. No. 06/738,499 filed May 28, 1985, now abandoned, which is a continuation of application Ser. No. 06/507,255 filed Jun. 23, 1983 now abandoned.

FIELD OF THE INVENTION

This invention relates to the manufacture of alloy powder, and, more particularly, to the manufacture of a superalloy powder characterized by reduced amounts of impurities.

DESCRIPTION OF THE PRIOR ART

A wide variety of alloy powder manufacturing methods and apparatus are well known in the metallurgical art. As such manufacture relates to high temperature alloys and superalloys, for example the type based on Fe, Co, Ni, Ti or their combinations, current powder production methods include first melting the alloy elements in a high vacuum furnace chamber through use of vacuum electron beam, vacuum arc, vacuum induction or vacuum plasma melting to produce an ingot. After production of the alloy ingot, current powder production converts the alloy ingot into powder by such methods as gas atomization, rotary atomization and vacuum atomization utilizing ceramic hearth primary melting in conjunction with a ceramic tundish and nozzle for producing a liquid metal stream needed to produce powder.

Certain high temperature operating and highly stressed components of gas turbine engines, for example, turbine disks, use powder metal in their manufacture. By producing a powder metal preform nearly to the final shape of the component, manufacturing costs can be reduced. However, it has been recognized that inadequate powder cleanliness, particularly from ceramic particles introduced in currently used powder manufacturing processes, can result in a significant reduction in such mechanical properties as low cycle fatigue in the finished component. This reduction is due to the presence in the consolidated powder metal disks of defects which act as initiation sites for low cycle fatigue failures. Nearly all superalloy powder metal for such applications currently are produced by first providing an ingot, melting the ingot and then making powder by gas atomization processes. Such atomization processes utilize ceramic melting and pouring devices and it has been found that these devices introduce a significant proportion of the undesirable ceramic inclusions. It should be recognized that the present invention can be particularly useful when the starting materials are relatively free of such ceramic inclusions.

SUMMARY OF THE INVENTION

It is a principal object of the present invention to provide an improved method for making an alloy powder in which the melting is conducted without contact with ceramic members and powder is made directly from the molten alloy.

Another object is to provide apparatus for producing an alloy powder, improved through a means to melt the metallic materials of the alloy out of contact with ceramic members.

These and other objects and advantages will be more clearly understood from the following detailed description of the preferred embodiments and the drawing all of which are intended to be typical of rather than in any way limiting on the scope of the present invention.

Briefly, the method of the present invention, in one form, provides a melting hearth having fluid-cooled walls and in which is disposed the metallic material which define an alloy composition. The metallic material is then melted in the hearth. In one specific embodiment, a plasma heat source is directed at and may be swept over the metallic material and the hearth to provide substantially uniform heat to the metallic material to initiate and conduct melting of the metallic material. While melting is conducted, a cooling fluid is provided in the walls of the hearth sufficient to resolidify melted metallic material adjacent to the cooled hearth walls. This forms a skull of metallic material within the hearth at the cooled walls while maintaining additional molten alloy as a molten metal reservoir within the skull. Then the additional molten alloy is introduced from the hearth into a powder metal producer.

One form of the apparatus of the present invention provides, in combination, means to melt the metallic material comprising a fluid-cooled hearth for receiving metallic material, a plasma heat source to melt the metallic material in the hearth and to provide a molten metal reservoir, a powder metal producer, and means to introduce the molten metal from the reservoir into the powder metal producer. In one form, the means to melt the metallic material is a movable plasma heat source directed toward the hearth and adapted, during operation, to sweep a surface of metallic material in the hearth to provide substantially uniform heat to the metallic material.

BRIEF DESCRIPTION OF THE DRAWING

The drawing is a partially sectional, diagrammatic view of one form of the present invention including an improved melt chamber and a metallic powder producer.

DESCRIPTION OF THE PREFERRED EMBODIMENTS

The development of modern aircraft gas turbine engines has defined requirements for higher temperature operating materials capable of withstanding high stresses. The complexity of component design and the advances in powder metallurgy processing and alloy definition have made the use of powder metal attractive from an economic manufacturing viewpoint. In addition, powder alloy use has the capability of achieving desirable properties such as low cycle fatigue resistance along with high temperature operating capability.

Typical of such a component requiring very high strength, high temperature materials are rotating disks used in the turbine section of modern gas turbine engines. Other engine components, such as of Ti-base alloys, sometimes are used in the compressor section. However, in order to achieve desirable low cycle fatigue capability, it has been recognized that certain types of impurities must be eliminated from the powder alloy used in such processing.

It has been observed that a major impurity which results in defects in such disks is ceramic in nature and can be traced to initial starting material or the subsequent processing required to produce powder from the alloy. The presence of such defects can reduce the low cycle fatigue capability of such disks below that required under high temperature and high stress conditions.

For the production of powder metal from superalloys, for example of the type based on Fe, Co, Ni or their combinations, gas atomization processes are used with ceramic melting and pouring devices. Such ceramic structures introduce a significant portion of the ceramic impurity material which constitutes defects serving as low cycle fatigue fracture initiation sites in the finished component manufactured by powder metallurgy techniques.

The present invention avoids contact between ceramic members and the alloy from which the powder is manufactured by melting metallic material, out of contact with ceramic members and introducing that molten alloy into a powder metal producer. In one form, this is accomplished by the combination of the use of a fluid-cooled melting hearth and a plasma heat source which may be movable, in the melt chamber or melting apparatus in which the materials of the alloy are melted prior to introduction into a powder metal producer. The fluid-cooled hearth causes resolidification of molten material in the hearth about the walls of the hearth. This forms a hearth skull of metallic material as a barrier between material of the hearth and the molten alloy remaining in the hearth skull.

Use of a movable plasma heat source, such as one or more movable plasma torches which together define the plasma heat source, provides rapid and uniform heating and melting of the materials defining the composition of the alloy to be made into powder. In addition, superheating of the molten material to a temperature sufficient and practical for introduction into a metal powder producer can be assisted through the use of such movable, primary plasma heat source which is adapted to sweep over a surface of the metallic material in the hearth.

One form of the apparatus of the present invention is shown in the drawing. The improved means to melt the metallic material in melting chamber 10 includes a fluid-cooled hearth 12 including walls 13 having fluid-cooling passages 14 therein connected with a source of cooling fluid such as water (not shown). As used herein, the term "wall" or "walls" may include the base or floor as well as the side walls, as desired, of the member being described. Melting chamber 10 can be adapted to enclose a desired atmosphere or pressure condition for example by introducing an inert gas such as argon into inlet 16, to be evacuated through gas outlet 18. Appropriate other means to control the atmosphere within melt chamber 10 will be recognized by those skilled in the art, according to a variety of methods currently used. Disposed above hearth 12 is a plasma heat source 20 shown in the drawing as a plurality of plasma torches, which may be movable, directed toward hearth 12. With metallic material 22 introduced in the hearth 12, plasma heat source 20 is adapted to initiate and further the melting of such materials. When movable, plasma heat source 20 is adapted to sweep over a surface of the metallic material and to provide substantially uniform heat to such material.

During the operation of the above-described improved melting means, metallic material 22, which defines an alloy composition, is disposed in hearth 12. Such introduction can be in a batch-type process or can be in a continuous or semi-continuous process employing a supplementary metal feed system of a type well known in the art. For example, a chute and feed mechanism of the type shown in U.S. Pat. No. 3,744,943-Bomberger, Jr. et al issued Jul. 10, 1973, can be used. The disclosure of that patent is incorporated herein by reference.

With cooling fluid such as water circulating within cooling passages 14, plasma heat source 20 such as a battery of movable plasma heat torches are placed in operation. In this embodiment, the torches are moved to sweep a surface of the material 22 in hearth 12 to melt such material. As molten material contacts the cooled inner wall of hearth 12, such material resolidifies into a hearth skull 24 which acts as a barrier or buffer between the hearth walls and other melted material and alloy in the hearth. In this way, hearth material is prohibited from being introduced into the molten alloy within the hearth and a reservoir of molten alloy is provided substantially free of foreign materials.

After a desirable level of melting and superheat is achieved, the hearth is tipped such as about pivot 26 using a tipping means or mechanism represented by arrow 28. Molten alloy in the hearth, remaining from that material which was resolidified to form skull 24, is discharged or poured from the hearth, conveniently from a hearth lip 30 to provide a molten metal stream 32. In the drawing, according to one form of the present invention, molten metal stream 32 is poured into a stream control device in the form of a fluid-cooled trough 34 for supplemental handling. However, it should be understood that molten metal stream 32 can be introduced into any of several other stream control devices of a type apparent to those skilled in the art or directly into a powder metal producer.

In the form of the invention shown in the drawing, molten metal stream 32 is introduced into a stream control device comprising fluid-cooled trough 34 which includes fluid-cooling passages 36 supplied from a cooling fluid source such as water (not shown) in a manner well known in the art. Similar to the hearth 12, trough 34 can include a lip 38 to assist flow of molten metal from trough 34.

In operation, trough 34 receives molten alloy in stream 32 from hearth 12 while cooling fluid is circulated through cooling passages 36. As the molten metal contacts the cooled walls of the trough, a portion of the molten metal solidifies forming a trough skull 40 similar to hearth skull 24. Skull 40 functions, in the same manner, as a barrier or buffer between walls of the trough and molten alloy maintained in the trough after solidification of the trough skull. To maintain such additional alloy in the trough in the molten state, a secondary plasma heat source such as shown in the drawing as a plasma heat torch 42 may be desired or required. During operation, secondary plasma heat source 42 is directed at the additional molten alloy in the trough remaining from that which has resolidified as trough skull 40. A stream 44 of molten alloy flows from trough 34 into a powder metal producer shown generally at 46 in the drawing. The stream of molten alloy is converted from the liquid phase to a powder in the powder metal producer 46.

Such a metal powder producer can be of a variety of types well known in the art, for example atomization or other disintegration type devices which produce metal powders. The drawing shows diagrammatically one of the gas atomization type which includes a cooling tower 48 having a molten metal inlet 50 about which is disposed an atomizing gas spray means 52 to inject atomizing gas such as argon, nitrogen, helium, etc., into molten metal stream 44 entering cooling tower 48 through inlet 50. Such an atomizing gas is fed through conduit 54 from a pressurized gas source (not shown). The atomizing gas thus introduced into the molten alloy stream causes the stream to disperse into small particles which solidify and fall to the bottom of cooling tower 48 to be collected in metal powder collector 56. As shown in the drawing, it is convenient to include with such a powder metal producer an exhaust system shown at 58. Generally the exhaust system includes a fines or dust collector 60, for example of the cyclone collector type well known in the art.

If desired, supplemental heat sources can be used in melting chamber 10, for example directed at hearth lip 30 or at trough lip 38, or both. This can assist molten alloy streams such as 32 and 44 to pour in a desired molten condition or superheat.

In one example of the evaluation of the improved melt chamber or means to melt the metallic material of the present invention, a nickel-base superalloy commercially available as René 95 alloy and having a nominal composition, by weight, of 0.06% C, 13% Cr, 8% Co, 3.5% Mo, 3.5% Cb, 0.05% Zr, 2.5% Ti, 3.5% Al, 0.01% B, 3.5% W with the balance Ni and incidental impurities was used. In the evaluation, three plasma heat torches as the primary heat source 20 were focused on a water-cooled copper melting hearth 12. An additional plasma heat torch as a secondary plasma heat source 42 can be focused on a water-cooled copper pouring trough 34, as shown in the drawing. In other evaluations of melting in hearth 12, fewer than three torches were used. The hearth heating torches, as the primary plasma heat source, were movable in three orthogonal directions; the pouring trough heating torch or secondary plasma heat source was movable in the vertical and one horizontal direction. The sides of the apparatus and the supports for the plasma torches were protected by heat shields. As a result of several trial evaluations, it was found that the combination of a fluid-cooled hearth and a plasma heat source, which may be movable, alone or in combination with a pouring trough as a stream control device, can provide an improved means to melt a metallic material for the purpose of producing a powder metal and without a substantial increase of ceramic impurities which can act as defect sites.

Through the use of the apparatus of the present invention, there is provided an improved method for making an alloy powder, especially one of a high temperature alloy or superalloy such as based on Fe, Co, Ni, or Ti or their mixtures, the method being characterized by the substantial avoidance of addition of defect-forming ceramic materials.

This invention has been described in connection with specific embodiments and examples. However, it will be readily recognized by those skilled in the art the various modifications and variations of which the present invention is capable without departing from its scope as represented by the appended claims.

What is claimed is:

1. In a method for making a metal powder, the steps of:

disposing in a fluid-cooled hearth having delivery means a metallic material defining an alloy composition;

melting the material in the hearth using a plasma heat source to provide a molten metallic alloy while providing a skull of resolidified material substantially completely between the molten alloy and the hearth and said delivery means; and delivering the molten metallic alloy from the fluid-cooled hearth into a powder metal producer, wherein, in said method, the molten alloy substantially contacts only said skull.

2. An improved method for making a metal powder comprising the steps of:

providing a hearth having delivery means, said hearth and delivery means having fluid-cooled walls;

disposing in the hearth a metallic material defining an alloy composition;

directing a plasma heat source at the metallic material in the hearth to melt the metallic material;

providing cooling fluid in the walls sufficient to resolidify melted metallic material adjacent to the cooled walls to form a skull of a portion of the metallic material substantially completely on the cooled walls, while maintaining molten alloy in the hearth, and separated therefrom by the skull, as a molten alloy reservoir; and delivering a stream of the molten alloy from the hearth into a powder metal producer, wherein, in said improved method, said molten alloy substantially contacts only said skull.

3. The method of claim 2 in which the plasma heat source is swept over a surface of the metallic material to provide substantially uniform heat to the metallic material.

4. The method of claim 2 further including delivering the molten alloy into the powder metal producer through a stream control device, said device having a second delivery means and having a skull formed therein substantially completely between said stream control device and said second delivery means and the molten alloy wherein said molten alloy substantially only contacts said skull.

5. The method of claim 4 wherein:

a pouring trough having fluid-cooled walls is the stream control device.

6. The method of claim 5 including directing a secondary plasma heat source at the molten alloy in the trough.

7. The method of claim 6 including sweeping the secondary plasma heat source over the surface of the molten alloy in the trough to provide substantially uniform heat to the molten alloy.

8. The method of claim 2 including delivering the molten alloy into the powder metal producer by tipping the hearth.

9. The method of claim 2 including injecting an atomizing gas into the stream of molten alloy delivered to the powder metal producer to solidify the alloy in powder form.

10. The method of claim 9 including collecting the powder metal alloy.

11. An improved method for making a metal alloy powder comprising the steps of:

providing a hearth having delivery means, said hearth and delivery means having fluid-cooled walls;

disposing in the hearth a metallic material defining an alloy composition;

directing a plasma heat source at the metallic material in the hearth to melt the metallic material;

providing cooling fluid in the walls sufficient to resolidify melted metallic material adjacent to the cooled walls to form a skull of a portion of the metallic material substantially completely within the hearth and the delivery means at the cooled walls, while maintaining molten alloy in the hearth, and separated therefrom by the skull, as a molten alloy reservoir;

delivering the molten alloy from the hearth into a stream control device, said stream control device comprising a pouring trough having a second delivery means, the walls of which trough are fluid-cooled, said trough having a skull formed therein substantially completely between the molten alloy and said fluid-cooled walls;

sweeping a secondary plasma heat source over the surface of the molten alloy in said trough to maintain the alloy molten in the trough;

delivering a stream of molten alloy from the trough to a powder metal producer;

injecting an atomizing gas into the molten alloy stream;

converting the molten alloy to powder alloy; and collecting the powder metal alloy, wherein, in said improved method, said molten alloy substantially contacts only said skull.

12. An improved method for making a metal powder from a metallic material defining an alloy composition comprising the steps of melting the metallic material in a fluid-cooled hearth having delivery means and delivering the molten metallic material into a powder metal producer, the improvement comprising:

forming a skull of resolidified metallic material substantially completely between said molten metallic material and said hearth and delivery means; and contacting said molten metallic material substantially only with said skull.

13. In an apparatus for producing a powder metal alloy from a molten metallic alloy, the improvement comprising:

a metal powder producer;

a fluid-cooled hearth having fluid cooled walls for melting the metallic alloy, said hearth further having a lip for delivering a stream of the molten alloy substantially out of contact with ceramic members to the metal powder producer;

a skull of resolidified alloy having substantially the same composition as the molten metallic alloy, formed on the hearth and lip by removal of heat through said fluid-cooled walls so that molten alloy is substantially out of contact with said hearth and lip;

a plasma heat source;

means for directing the heat source toward the hearth for melting the metallic alloy and maintaining said stream of molten metallic alloy;

a melt chamber enclosing at least the hearth, the heat source and the alloy stream to maintain an inert gas atmosphere over the molten alloy; and means in said metal powder producer for converting the molten alloy stream to a powder alloy metal.

14. The apparatus of claim 13 further comprising means for directing the heat source to sweep the surface of the metallic alloy in the hearth to provide substantially uniform heat to the metallic alloy.

15. The apparatus of claim 13 further comprising:

a fluid-cooled pouring trough disposed within the melt chamber to receive molten metallic alloy melted in the hearth and to deliver at least a portion of such molten metallic alloy substantially out of contact with ceramic members into the means for converting the molten alloy to a powder metal, said trough having fluid-cooled walls; and a skull of resolidified alloy, having substantially the same composition as the alloy melted, substantially completely between the molten alloy and the fluid-cooled walls so as to prevent contact between the molten alloy and trough walls.

16. The apparatus of claim 15 further comprising a secondary plasma heat source directed toward the trough to maintain at least a portion of the metallic alloy molten in the trough.

17. The apparatus of claim 13 further including means for tipping the hearth to deliver a molten alloy stream.

18. The apparatus of claim 13 wherein the means for converting the molten metal alloy stream to a metal powder comprises:

an inlet for receiving the molten alloy stream;

a source of atomizing gas selected from the group consisting of helium, argon and nitrogen;

atomizing gas spray means for injecting the atomizing gas into the stream of molten alloy after entry into the inlet.

19. The apparatus of claim 18 wherein the means for converting the molten alloy stream to a powder metal further comprises:

a cooling tower through which the powder metal passes; and a collector for the powder metal that has passed through the cooling tower.

20. In an apparatus for producing a substantially ceramic-free metal powder from a molten metallic alloy stream, the improvement comprising:

a hearth for receiving the metallic alloy, said hearth including a lip for delivering the molten alloy stream, said hearth and lip having fluid-cooled walls;

a plasma heat source which is adapted, during operation, to sweep a surface of metallic alloy in the hearth to provide substantially uniform heat to melt the metallic alloy and partially maintain it in the molten state;

a skull of resolidified alloy having substantially the same composition as the molten metallic alloy, formed on the hearth and lip by removal of heat through said fluid-cooled walls so that molten alloy is substantially out of contact with said hearth and lip;

a stream control device, said stream control device comprising a pouring trough disposed to receive molten alloy melted is the hearth, and said trough having means for pouring a stream of molten alloy from the trough into a metal powder producer, said trough and pouring means further having fluid cooled walls for establishing a skull of solidified alloy between the molten alloy and said walls to prevent contact of the walls and the molten metal stream;

a means for tipping the hearth for delivering molten alloy to the stream control device;

a secondary plasma heat source which is adapted, during operation, to maintain at least a portion of the alloy molten in the trough;

a melt chamber enclosing at least the hearth, the heat sources, the stream control device and the alloy stream to maintain an inert gas atmosphere over the molten alloy; and a source of atomizing gas;

an atomizing gas spray means for injecting the atomizing gas into the stream of molten alloy poured from the trough to convert the molten alloy to substantially ceramic-free powder alloy;

a cooling tower through which the substantially ceramic-free powder alloy passes; and a powder collector for collecting the powder alloy that has passed through the cooling tower, wherein, in said apparatus, said molten alloy substantially contacts only said skull said that contact between said molten alloy and walls, from the hearth to the powder collector, is essentially prevented and contamination of the powder is substantially eliminated.

* * * * *

UNITED STATES PATENT AND TRADEMARK OFFICE

CERTIFICATE OF CORRECTION

PATENT NO. : 5,120,352

DATED : June 9, 1992

INVENTOR(S) : Joseph J. Jackson, Richard G. Menzies, Joseph Hopkins

It is certified that error appears in the above-identified patent and that said Letters Patent is hereby corrected as shown below:

On the cover page, Column 1 after "[21] Appl. No.:", delete "779,827" and substitute therefor --679,816--.

On the cover page, Column 1 after "[22] Filed:", delete "May 2, 1992" and substitute therefor --April 1, 1991--.

Signed and Sealed this

Twenty-eighth Day of June, 1994

*Attest:*

Bruce Lehman

BRUCE LEHMAN

*Attesting Officer*

*Commissioner of Patents and Trademarks*